United States Patent [19]

Sasano et al.

[11] 4,331,506

[45] May 25, 1982

[54] METHOD OF MANUFACTURING TARGET OF IMAGE PICKUP TUBE

[75] Inventors: Akira Sasano; Toshio Nakano, both of Hinodemachi; Ken Tsutsui, Hachioji; Chushiro Kusano, Kokubunji; Tadaaki Hirai, Koganei; Eiichi Maruyama, Kodaira, all of Japan

[73] Assignees: Hitachi, Ltd.; Hitachi Denshi Kabushiki Kaisha, both of Tokyo, Japan

[21] Appl. No.: 212,213

[22] Filed: Dec. 2, 1980

Related U.S. Application Data

[63] Continuation of Ser. No. 8,835, Feb. 2, 1979, abandoned.

[30] Foreign Application Priority Data

Feb. 17, 1978 [JP] Japan ..... 53/16482

[51] Int. Cl.[3] ..... H01J 31/26

[52] U.S. Cl. ..... 156/633; 156/657; 156/659.1; 156/655; 313/386; 313/390; 427/75; 427/250; 427/99

[58] Field of Search ..... 156/633, 629, 657, 659.1, 156/655; 29/25.11, 25.17, 25.18; 430/314, 315, 317; 313/371, 384, 386, 390; 427/250, 74, 75

[56] References Cited

U.S. PATENT DOCUMENTS

| | | | |
|---|---|---|---|
| 3,986,069 | 10/1976 | Funahashi | 427/75 |
| 3,997,810 | 12/1976 | Tsutsui et al. | 313/384 |
| 4,107,568 | 8/1978 | Nakano et al. | 313/371 |
| 4,181,755 | 1/1980 | Liu et al. | 156/659.1 |
| 4,251,909 | 2/1981 | Hoeberechts | 156/657 |

FOREIGN PATENT DOCUMENTS

| | | | |
|---|---|---|---|
| 5124671 | 9/1979 | Japan | 29/25.17 |

OTHER PUBLICATIONS

Sasano et al., "A Novel . . . Camera", IEDM Technical Digest 1974, pp. 74–77.

Borkar "Simultaneous . . . Vidicon", RCA Review, Mar. 1960, pp. 3–16.

Weimer et al., "A Development . . . Target", IRE Transactions on Electron Devices, Jul. 1960, pp. 147–153.

Gray et al., "Production . . . Evaporation", RCA Review, Sep. 1959, pp. 413–425.

*Primary Examiner*—Jerome W. Massie

*Attorney, Agent, or Firm*—Craig & Antonelli

[57] ABSTRACT

A method of manufacturing a target of an image pickup tube comprising the steps of: forming a plurality of groups of transparent conductive signal electrodes on a transparent insulating base plate; forming a first layer on at least a portion constituting an image area of the image pickup tube, said first layer being substantially insoluble in etching liquid used for etching an insulating layer to constitute an intermediate layer insulator in a double layered interconnection structure; forming, after formation of said first layer, an insulating layer to constitute said intermediate-layer insulator; removing a predetermined portion of said insulating layer, removing said first layer together with said insulating layer located thereon; forming bus bars; and forming a photoconductive layer on said plurality of groups of the transparent conductive signal electrodes.

This invention provides an excellent method for mass production.

6 Claims, 26 Drawing Figures

METHOD OF MANUFACTURING TARGET OF IMAGE PICKUP TUBE

This is a continuation of application Ser. No. 8,835, filed Feb. 2, 1979, now abandoned.

BACKGROUND OF THE INVENTION

1. Field of the Invention

This invention relates to a method of manufacturing a target of an image pickup tube or the like used in a color camera of single tube type or double tube type, and more particularly to a method of manufacturing the target wherein groups of signal electrodes are connected to bus bars for drawing out the signal electrodes to the outside of the tube on the face plate thereof, connection of at least one of the signal electrodes being made through an insulating layer by a double layered interconnection structure.

2. Description of the Prior Art

Targets having striped transparent electrodes for use in image pickup tubes have been disclosed, for example, by S. Gray and P. K. Weimer in the RCA Review, Sept., 1959, pp. 413 to 425; by P. K. Weimer, S. Gray, et al in the IRE Transactions on Electron Devices, July, 1960, pp. 147 to 153; and by Harold Borkan in the RCA Review, Mar., 1960, pp. 3 to 16. The inventors also have made a description of such a target in a report tytled "A Novel Tri-Color Pickup Tube for Use in a Single Tube Color TV Camera" in the 1974 Iedm Technical Digest, p. 74.

Conventional methods of manufacturing targets used in image pickup tubes have included some drawbacks. Such drawbacks will now be described in reference to the method of manufacturing a typical target used in a trielectrode color pickup tube.

SUMMARY OF THE INVENTION

An object of the invention is to provide a novel method of forming a double layered interconnection structure wherein bus bars are connected through an insulating layer to the striped electrodes existing on the image area in the face plate for drawing them out as signal electrodes. No eave-like portion will be produced on the edge of the striped electrode, thus the invention provides an excellent method for mass production.

According to the fundamental procedure of the invention, the method of the invention comprises the steps of: forming a plurality of groups of transparent conductive signal electrodes on a transparent insulating base plate; forming, at least on a portion which is to constitute the image area of an image pickup tube, a layer which is substantially insoluble in an etching liquid which is used to etch an insulating layer adapted to become inter-layer insulator in a double layered interconnection structure; forming, after formation of the layer, an insulating layer which is adapted to become the interlayer insulator; removing a predetermined portion of the insulating layer adapted to become the interlayer insulator; removing the layer together with the insulating layer formed thereon; and forming a photoconductive layer on the plurality of groups of the transparent signal electrodes.

Figure 4:
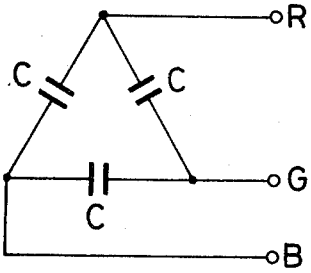
Figure 6:
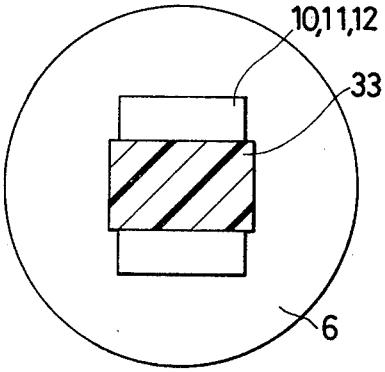

FIGS. *3a* to *3h* are sectional views explaining a prior art method of manufacturing the target;

FIG. 4 shows an equivalent circuit of the bus bar portion in the target of the tri-electrode image pickup tube;

FIGS. *5a* to *5n* are sectional views for explaining a method of manufacturing a target according to the invention; and FIG. 6 is a plan view illustrating the state of the face plate at the time of forming a protective layer.

Figure 1:
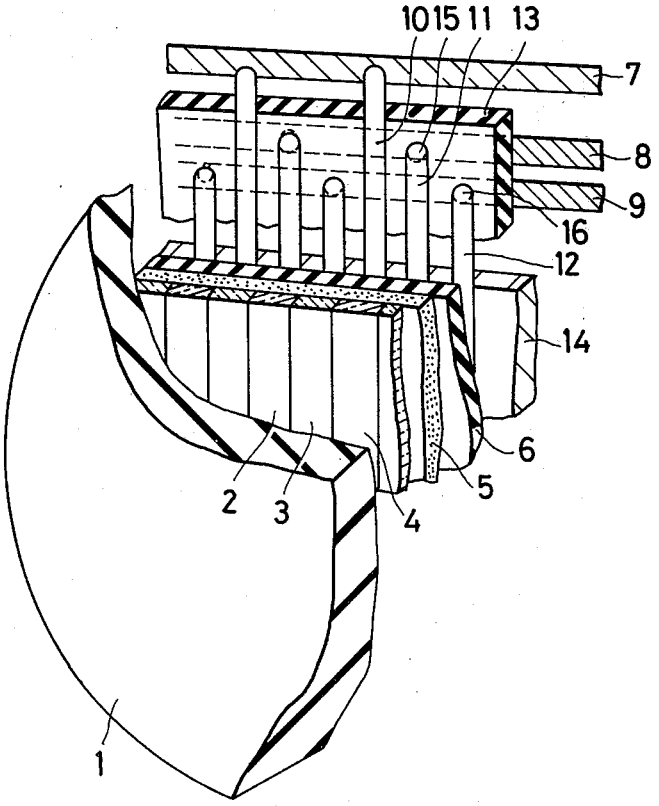
FIG. 1 shows the construction of a prior art target in a trielectrode image pickup tube.

The fundamental structure of a target used in a trielectrode color pickup tube is shown in FIG. 1. According to FIG. 1, on a transparent insulating base plate 1 such as a glass plate are arranged in a cyclic manner striped filters which permit transmission of light of the three primary colors of red, green and blue, respectively. In the figure, the filters corresponding respectively to the three original colors are indicated by the numerals 2, 3 and 4. In a reverse type target, complementary color filters are alternatively used. On the filters 2, 3 and 4 is bonded by means of a binding material 5 a transparent insulating thin plate 6 such as a glass plate. On this plate 6 are formed groups of transparent signal electrodes, each group consisting of electrodes 10, 11 and 12. These transparent signal electrodes are divided into groups according to the original colors to which they correspond, and are connected, outside the image area, to corresponding bus bars 7, 8 and 9. In the illustrated example, the signal electrodes 11 and 12 are connected through an insulating layer 13 to the bus bars 8 and 9, respectively. The numerals 15 and 16 indicate holes provided in the insulating layer 13 for the purpose of interconnection between the electrodes 11, 12 and the bus bars 8, 9. The signal electrode 10 is directly connected to the bus bar 7. A photoconductive layer 14 is superimposed on the groups of transparent electrodes 10, 11 and 12. In some cases, a resistive layer consisting of a uniform thin metal layer or oxide layer is provided to interconnect the striped electrodes and adjacent electrodes, and the photoconductive layer is superimposed on this resistive layer. This latter construction will be described hereinafter.

Figure 2:
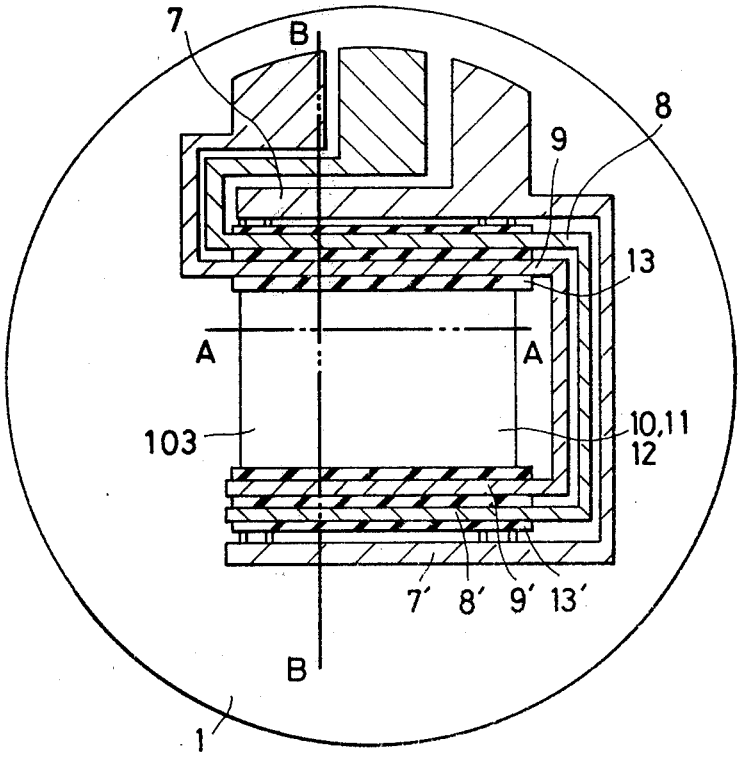
FIG. 2 is a plan view of the target shown in FIG. 1.

FIG. 2 is a plan view of the target. According to FIG. 2, the numeral 103 indicates the image area in the face plate. Each of the bus bars 7, 8 and 9 has a generally C-shaped form surrounding the image area 103. Thus, the transparent signal electrodes 10, 11 and 12 are connected to the bus bars 7, 8 and 9 through the insulating layers 13 and 13' on the oppoiste sides of the image area. Such manner of connection of the transparent signal electrode wherein the electrode is connected at its opposite ends to the bus bar, is not always necessary, but has an advantage of reducing thermal noise by virtue of actual decrease in resistance of the electrode.

In the above-described construction, the target includes a double layered structure wherein the transparent signal electrodes 11 and 12 are connected to the bus bars 8 and 9 through the insulating layer 13. For forming such connection portion, a method is described hereinbelow.

Figure 3A:
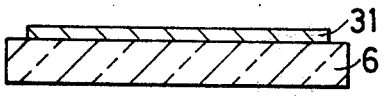
FIG. 3a PRIOR ART
Figure 3B:
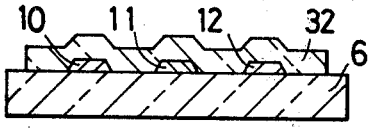
FIG. 3b PRIOR ART
Figure 3C:
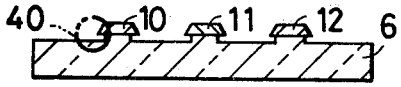
FIG. 3c PRIOR ART
Figure 3D:
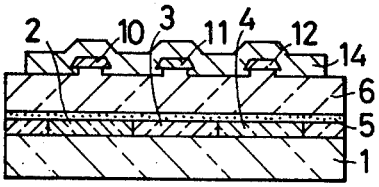
FIG. 3d PRIOR ART
Figure 3E:
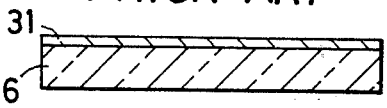
FIG. 3e PRIOR ART
Figure 3F:
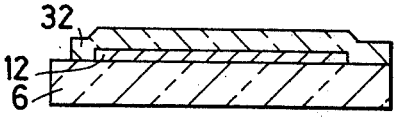
FIG. 3f PRIOR ART

FIGS. *3a* to *3h* show a fundamental manufacturing procedure for making such structure, FIGS. *3a* to *3d* being sectional views taken along the line A—A of FIG. 2, and FIGS. *3e* to *3h* being sectional views taken along the line B—B of FIG. 2. FIGS. *3a*, *3b*, *3c* and *3d* correspond respectively to FIGS. *3e*, *3f*, *3g* and *3h* at the respective steps of the procedure. A transparent conductive layer 31 is formed on the glass base plate 6 as shown in FIGS. 3*a* and 3*e*. This transparent conductive layer 31 is processed to form the groups of transparent signal electrodes 10, 11 and 12. In such a process, the layer 31 may be etched through a mask of a photoresist layer by utilizing a sputtering phenomenon. A glass layer 32 is then deposited by sputtering technique on the base plate 6 to cover the signal electrodes 10, 11 and 12 as shown in FIGS. 3*b* and 3*f*. The glass layer 32 is in itself needed only on an area which is to be occupied by the double layered structure. Accordingly, it might be considered possible to deposit this glass layer with the use of a mask covering the image area. However, in general, insulating layers such as glass layers are made by means of sputtering technique, which is, in this case, accompanied by a large diffractive phenomenon of sputtered material with respect to the mask. Accordingly, the sputtering technique using a mask cannot be employed in manufacturing targets of image pickup tubes. Consequently, it is necessary to deposit the glass layer 32 uniformly on the whole area of the face plate.

Figure 3G:
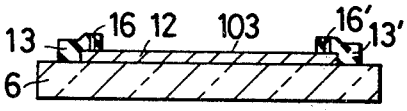
FIG. 3g PRIOR ART
Figure 3H:
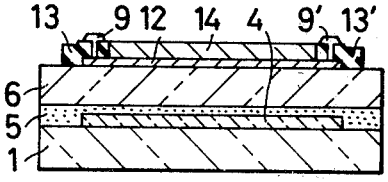
FIG. 3h PRIOR ART

After having deposited this glass layer 32, photoetching technique is used to partially remove the glass layer thereby to expose the image area 103 and to form the holes 16 and 16' used for the double layered interconnection. At this time, the portion of the glass layer 32 which has been on the image area 103 must be completely removed. Accordingly, in order to obtain a sufficient effect in mass production, over-etching to some extent is further required after the above-described partial removal of the glass layer 32 due to the etching liquid. This causes some etching against areas of the base plate 6 exposed between the striped transparent electrodes as shown in FIGS. 3*c* and 3*g*. Bus bar patterns 9 and 9' are then formed on the insulating glass layers 13 and 13' by means of evaporation technique. Further, the color filters 2, 3 and 4 are provided on one side of the glass base plate 6. These color filters 2, 3 and 4 have been formed beforehand on the transparent insulating base plate 1 and are bonded to the base glass plate 6 by means of the binding material 5. Then, the photoconductive layer 14 is formed. FIGS. 3*d* and 3*h* show the thus completed state of the target.

The target which has been manufactured by the above-described method, however, includes some disadvantages such as the following. As seen in FIG. 3*c*, an overhanging eave-like portion 40 is formed, at the time of the above-described removal of the glass layer 32, on the edge of the striped electrode by the over-etching process which is necessary in mass production.

Formation of this eave-like portion 40 is due to the fact that both the glass base plate 6 and the insulating glass layer 32 formed thereon consist mainly of $SiO_2$, and accordingly both of them are etched by the etching liquid (consisting mainly of HF). This problem may be relieved to some extent by adequately selecting compositions of the base glass plate, the glass layer and the etching liquid. However, even with the best combination of compositions of the base glass plate, the glass layer and the etching liquid which can be obtained by the current art, over-etching of the order of 200 to 300 Å of the base glass plate is inevitable.

As a result, a problem occurs which will be described hereinbelow.

When the photoconductive layer is formed on the striped transparent electrode, probability of breaking of the photoconductive layer is increased by the stepped shape of the eave on the edge of the electrode. Especially, in case the photoconductive layer forms blocking contact with the signal electrode, the blocking contact will be broken down at the stepped portion of the eave, resulting in an increased dark current and formation of white streak. When the stepped eaves are as small as the order of 200 to 300 Å, initial operational characteristics of the target will in most cases not be affected. However, in operation of over several tens of hours, formation of white streak and an increased dark current will be brought about.

A technique has been developed wherein a resistive layer (referred to as a leak resistive layer hereinbelow) consisting of a uniform thin metal layer or oxide layer is provided on the striped transparent signal electrodes in a manner of making interconnection between adjacent electrodes, and the photoconductive layer is formed on this resistive layer. In this case, however, another problem occurs as described below. This technique relating to the leak resistive layer is for the purpose of improving lag characteristic, which will be briefly described hereinbelow. In an image pickup tube having signal electrodes formed into a striped-shape, migration speed of photo-carriers which are produced between the striped electrodes is smaller than that of photo-carriers which are produced just above the striped electrode. This fact causes an undesirable influence on the lag characteristic. The above-mentioned leak resistive layer is a layer provided for the purpose of avoiding such undesirable influence. Surface resistance of the leak resistive layer is preferred to be the order of $10^9$ to $10^{13}$ $\Omega/cm^2$. Thickness of the leak resistive layer may be about 10 Å in case it consists of a metal layer, while several hundreds Å in case of an oxide layer.

In a target of the tri-electrode type, a plurality of groups of striped electrodes corresponding respectively to the original colors are provided in a proximity relationship with respect to each other. As a result, electrostatic capacity will be produced between the three groups of electrodes (corresponding respectively to red, green and blue colors, for example) to produce mixing of colors. An equivalent circuit formed between the electrodes is shown in FIG. 4. The electrostatic capacity produced between the tri-electrodes depends primarily on the clearance between the striped electrodes, such capacity being preferred to be as small as possible. When a thin resistive layer is formed on an image area which includes therein transparent electrodes having eave-like portions such as described above, the resistive layer will be broken in its major part by the eave-like portions, and be only locally continued. As a result, additional electrostatic capacity will be produced in the eave-like portions. Accordingly, an extraordinarily large electrostatic capacity will exist between the tri-electrodes, thus making color mixing very difficult to be avoided.

This invention has been accomplished to eliminate the above-described drawbacks encountered in the prior art.

DETAILED DESCRIPTION OF THE INVENTION

The invention will now be described in detail.

In a procedure of manufacturing a target, it is important to employ means for covering, before forming an insulating layer such as a glass layer, at least the edge of striped electrodes with a protective layer. This protective layer is made of a material which is insoluble or sufficiently slow of dissolving in an etching liquid which is used to etch the insulating layer such as a glass layer. In processing the inter-layer or intermediate insulator layer by etching to remove a predetermined portion thereof, time required for over-etching is about 30 seconds. Accordingly, a protective layer which can substantially not be etched by the etching liquid in this over-etching time may suffice for use. (Such insolubility and such slow dissolving speed of the material will inclusively be referred to as being "substantially insoluble" hereinafter.) Organic high molecular resins such as photoresist and metals such as Cr, Pb and Sn are suitable materials for forming the protective layer. The protective layer is, in a practical procedure, formed over the whole image area. After the glass layer has been processed into a predetermined shape, the protective layer is removed. By this, the glass layer can be completely removed from the striped signal electrodes which constitute the image area, no eave-like portion being formed on the base glass.

The invention will now be described in detail with reference to the embodiments.

While there are several types of image pickup tubes which can be used in a color TV camera of signal tube type or double tube type, targets used in a tri-electrode pickup tube will be taken as examples for description of the invention. It should be understood, however, that the invention can be applied to the manufacture of targets for other types of pickup tubes.

EMBODIMENT 1

Figure 5A:
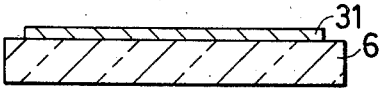
Figure 5B:
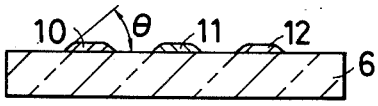
Figure 5C:
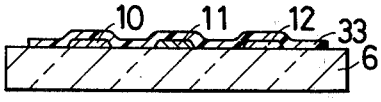
Figure 5D:
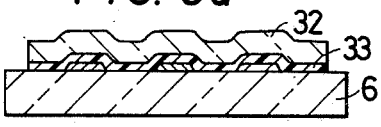
Figure 5E:
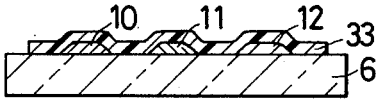
Figure 5F:
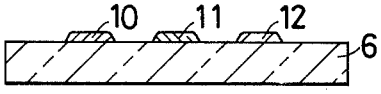
Figure 5G:
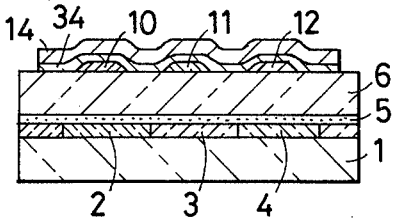
Figure 5H:
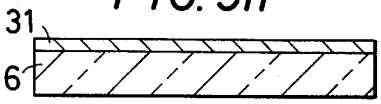
Figure 5I:
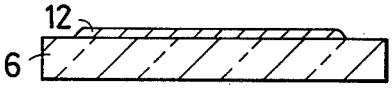
Figure 5J:
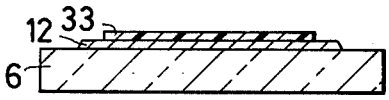
Figure 5K:
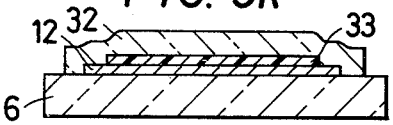
Figure 5L:
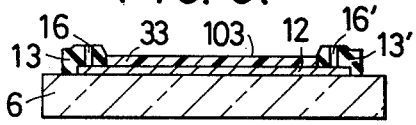
Figure 5M:
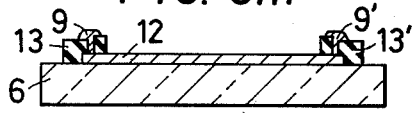
Figure 5N:
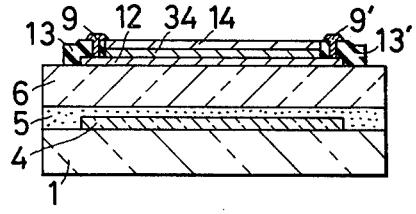

FIGS. 5*a* to 5*n* show a method of manufacturing a target according to the invention, FIGS. 5*a* to 5*g* being sectional views taken along the line A—A of FIG. 2 to show the states at respective steps of manufacturing procedure, and FIGS. 5*h* to 5*n* being sectional views taken along the line B—B of FIG. 2. FIGS. 5*a*, 5*b*, 5*c*, 5*d*, 5*e*, 5*f* and 5*g* correspond respectively to FIGS. 5*h*, 5*i*, 5*j*, 5*k*, 5*l*, 5*m* and 5*n*.

On a glass base plate 6 of 0.3 μm thickness was formed by means of a known spray technique a transparent conductive layer 31 consisting primarily of $SnO_2$, as shown in FIGS. 5*a* and 5*h*. On this transparent conductive layer 31 was formed a layer of photoresist (AZ-1350J available from Shipley Company, for example). This photoresist layer was shaped into a predetermined photoresist pattern according to an ordinary method of shaping photoresist pattern wherein exposure through a mask and development are made. This shaped photoresist pattern was subjected to irradiation of ultraviolet rays, which were stronger in intensity (up to 10,000 lx) than those used in the ordinary photoresist exposure, for 5 minutes, and then was heat treated at 150° C. for 30 minutes. This heat treatment may, in general, be made at 150° to 200° C. Thus prepared base plate was sputter-etched under an RF power density of 0.6 W/cm$^2$ for 30 minutes by the use of a sputter-etching apparatus. As the sputtering gas, were used experimentally three gases: (i) argon gas at $5\times10^{-3}$ Torr; (ii) argon gas at $5\times10^{-3}$ Torr containing 1% oxygen; and (iii) argon gas at $5\times10^{-3}$ Torr containing 3% oxygen. Then, the photoresist was removed by the use of a plasma-ashing device. Angles $\theta$ formed at the edges of the resultant transparent signal electrodes were (i) 15°, (ii) 10° and (iii) 3°, respectively. These transparent signal electrodes had a width of 12 μm and a length of about 10 mm. FIGS. 5*b* and 5*i* show the states of these resultant electrodes. In the case where the photoconductive layer makes blocking contact, the angle $\theta$ formed between the edge of the transparent signal electrode and the base plate is preferred to be 20° or less, more preferably 15° or less. By this, sticking undesirable in practical use can be avoided. For practical reasons in manufacture, the lower limit of $\theta$ is about 1°. The above-described facts are true of other materials, such as $In_2O_3$, for example, used for the transparent electrode.

While in the above has been described an example for making a slope on the edge of the transparent signal electrode, typical examples of such a method will be shown below:

(1) a method comprising the steps of: forming a transparent conductive layer on a predetermined base plate; forming on the transparent conductive layer a mask pattern of a predetermined shape made of posi-type organic sensitive material; heating the mask pattern to make a slope on the edge thereof; and treating the resultant transparent conductive layer by sputter-etching in an inactive gas or in an inactive gas containing oxygen; and (2) a method comprising the steps of: forming a transparent conductive layer on a predetermined base plate; forming on the transparent conductive layer a mask pattern of a predetermined shape made of posi-type organic sensitive material; exposing the mask pattern to ultraviolet rays; heating the mask pattern to make a slope on the edge thereof; and treating the resultant transparent conductive layer by sputter-etching in an inactive gas or in an inactive gas containing oxygen.

In either of the above-described methods, the sectional shape of the transparent conductive layer pattern can be controlled by controlling the sectional shape of the mask pattern and controlling the ratio of speeds of sputter-etching against the mask material and against the transparent conductive layer.

As the material for the mask pattern, organic high molecular materials are preferred, especially posi-type photoresist (novolak resin system materials, in general). Since the photoresist is an organic high molecular material, it can easily be deformed into a convex lens-like shape by heat treatment. Such deformation can be obtained more easily with the posi-type photoresist because the high molecular material thereof can be photodecomposed by ultraviolet irradiation. For example, when a layer of AZ-1350J (available from Shipley Company), which had been applied on the base plate, was exposed and developed in an ordinary manner, resultant angle $\theta$ was the order of 70° to 90°. When such layer was heat treated at 150° C. for about 30 minutes, $\theta$ was about 30°. Further, when such layer was exposed, developed, ultraviolet irradiated, and then heat treated under the same conditions as the above, $\theta$ was about 20°.

In the above, the overall sectional shape of the layer of such organic high molecular material is somewhat rounded when the material has been heat treated, and the slope at the end portion of the layer was evaluated by the angle formed between the surface of the base plate and the tangent line which touches the layer in the vicinity of the contact point of the rounded end portion of the layer to the base plate.

Speed of the sputter-etching can be controlled by mixing oxygen in inactive gas. As the partial pressure of $O_2$ increases, sputter-etching speed against the transparent conductive layer ($SnO_2$ layer, for example) decreases, while sputter-etching speed against the photoconductive layer increases. The above-described feature can also be obtained by sputtering conditions, other than the composition of gas. For example, pressure of sputtering gas is of the order of $10^{-3}$ to $10^{-2}$ Torr, and input power is of the order of 0.2 to 0.7 W/cm$^2$. When using a convex lens-like photoresist as a mask, as the partial pressure of $O_2$ increases, taper angle of the edge portion of the transparent conductive layer decreases. With the oxygen content in the range of 1% to 10%, high effectivity can be obtained.

It should be understood that application of the invention is not limited to the method of making a slope on the edge of the signal electrode.

Then, on the whole area of the glass base plate 6 was deposited by evaporation a Cr layer of 0.1 μm thickness as a protective layer 33. Cr is easy of practical use for making a protective layer. This Cr layer was etched with the use of ammonium cerium (IV) nitrate into a pattern which completely covers the image area 103. The state of this etched pattern is shown in the plan view of FIG. 6 and in the sectional views of FIGS. 5*c* and 5*j*. The numerals 10, 11 and 12 indicate the striped transparent signal electrodes. Suitable thickness of the protective layer is of the order of 0.05 to 0.3 μm.

An insulating glass layer of 2 μm thickness was deposited by means of sputtering technique, as shown in FIGS. 5*d* and 5*k*. This insulating glass layer was processed by means of a known photo-etching techinque into a shape required for forming a double layered interconnection structure. At the same time, holes 16 and 16' required for forming the double layered interconnection structure were made. The resultant state is shown in FIGS. 5*e* and 5*l*. Then, the Cr layer 33 was removed with the use of ammonium cerium (IV) nitrate. Cr-Au double layer of 4 μm thickness was deposited by evaporation to form bus bars 9 and 9'. (While only bus bars 9 and 9' are shown in the sectional views of FIG. 5, generally C-shaped bus bars 7, 7', 8, 8', 9 and 9' shown in the plan view of FIG. 2 were formed in a manner of surrounding the image area 103.) The resultant state is shown in FIGS. 5*f* and 5*m*. The double layered interconnection structure is shown at 12, 13, 13', 9 and 9' in FIG. 5*m*. To such prepared glass base plate 6 were bonded filters 2, 3 and 4 in position. These filters 2, 3 and 4 had been provided on a transparent insulating plate 1. The bonding against the glass base plate 6 was made by the use of sensitive binding material 5. Cr layer of 30 Å thickness was deposited by evaporation on the transparent signal electrodes 10, 11 and 12, and was adjusted to the predetermined resistance to form a leak resistive layer 34. Then, Se-Te-As amorphous layer of 4 μm thickness was deposited by evaporation to form a photoconductive layer 14 which made blocking contact with the signal electrode. Thus a target for use in image pickup tubes was completed. This target was incorporated in a tube to complete an image pickup tube which was studied as to its various characteristics. Table 1 shows, in comparison, characteristics of an image pickup tube incorporating a target made according to the conventional method and of the image pickup tube incorporating the target made according to the invention.

TABLE 1

| | Conventional tube | Tube according to the invention |
|---|---|---|
| Inter-electrode capacity | 400 pF | 150 pF |
| S/N | 40 dB | 46 dB |
| lag | 6 to 7% | 6 to 7% |

TABLE 1-continued

| | Conventional tube | Tube according to the invention |
|---|---|---|
| Sensitivity (20 lx) | 0.3 μA | 0.3 μA |

While a Cr layer has been described, in the above, as an example for forming the protective layer 33, any material which is substantially insoluble in the etching liquid can be used for forming the protective layer.

EMBODIMENT 2

This embodiment will be described with reference to FIG. 5.

On a glass base plate 6 of 0.3 μm thickness was formed according to a known method a transparent conductive layer 31 consisting mainly of $SnO_2$. On this transparent conductive layer 31 was formed a layer of photoresist (AZ-1350J available from Shipley Company, for example). This photoresist layer was, according to an ordinary method of forming photoresist patterns, exposed and developed to form a predetermined photoresist pattern. This photoresist pattern was heat treated at 150° C. for 30 minutes. Thus prepared base plate was then sputter-etched under a RF power density of 0.6 W/cm$^2$ for 35 minutes using a sputter-etching apparatus. As the sputtering gas, were experimentally used four gases: (i) argon gas at $5\times10^{-3}$ Torr containing 1% oxygen, (ii) argon gas at $5\times10^{-3}$ Torr containing 3% oxygen, (iii) argon gas at $5\times10^{-3}$ Torr containing 10% oxygen, and (iv) argon gas at $5\times10^{-3}$ Torr. Angles $\theta$ formed on the edge of the resultant transparent signal electrodes were (i) 15°, (ii) 6° to 7°, (iii) 2° to 4° and (iv) 25°, respectively.

Then, protective layers 33 and leak resistive layers 34 were formed by selectively using the materials shown in Table 2, respectively. Except for the selection of materials, methods of forming the layers were the same as described above. For removing the protective layers, the following etching liquids are preferred: nitric acid against Pb layer, nitric acid against Sn layer, photoresist removing liquid against photoresist layer, and the same liquid as in Embodiment 1 against Cr layer.

TABLE 2

| | Signal electrodes | | Protective layers | | Leak resistive layers | |
|---|---|---|---|---|---|---|
| No. | Materials | $\theta$ | Materials | Thickness | Materials | Thickness |
| 1 | $SnO_2$ | 7° | Pb | 1 μm | Cr | 30 Å |
| 2 | $SnO_2$ | 15° | Sn | 1 μm | Cr | 30 Å |
| 3 | $SnO_2$ | 25° | Photoresist | 1.5 μm | Cr | 30 Å |
| 4 | $SnO_2$ | 3° | Photoresist | 1 μm | $WO_3$ | 200 Å |
| 5 | $SnO_2$ | 7° | Cr | 0.1 μm | None | |

In the study of tubes made according to Table 2, No. 5 tube alone showed 11% in lag characteristic, while other tubes showed 6 to 7%. Other characteristics were the same as in Embodiment 1. No. 5 tube was inferior in after image characteristic because of incorporating no leak resistive layer therein, but showed an improved S/N characteristic which is an advantageous feature of the invention.

What is claimed is:

1. A method of manufacturing a target of an image pickup tube comprising the steps of:

(a) forming a plurality of groups of transparent conductive signal electrodes on a transparent insulating base plate including the image area thereof, (b) forming a protective layer on substantially said image area of said base plate, said protective layer being substantially unsoluble in an etching liquid by which a portion of an insulating layer constituting an intermediate layer of insulation may be etched away, (c) forming said insulating layer constituting said intermediate layer of insulation on the protective layer and on at least the portion of the signal electrodes serving as connection part between the signal electrodes and a location at which bus bars are to be applied, said layer being selectively removed from said image area by the etching liquid, (d) removing said protective layer, (e) mounting bus bars each electrically connected to corresponding transparent conductive signal electrodes via said connecting part and insulated from the remaining transparent conductive signal electrodes by an interposed intermediate isolation layer formed in said step (c), and (f) forming a photoconductive layer on at least a plurality of groups of transparent conductive signal electrodes in said image area.

2. A method of claim 1, characterized in that after the method step (e) color filters are provided on a face of said transparent insulating base plate which does not have any bus bars thereon.

3. A method of claim 1, characterized in that subsequent to method step (e) a leak resistive layer is formed over said plurality of groups of the transparent conductive signal electrodes and that in method step (f) the photoconductive layer is produced on said leak resistive layer.

4. A method of claim 1, characterized in that after the method step (e) color filters are provided on a face of said transparent insulating base plate which does not have any bus bars thereon, and a leak resistive layer is formed over said plurality of groups of the transparent conductive signal electrodes and that in method step (f) the photoconductive layer is produced on said leak resistive layer.

5. A method according to claim 1, 2, 3 or 4, wherein said layer formed in step (b) consists of a layer of organic high molecular resin.

6. A method according to claim 1, 2, 3 or 4, wherein said layer formed in step (b) consists of a metal layer deposited by evaporation.

* * * * *